US011543768B2

(12) United States Patent
Furukawa et al.

(10) Patent No.: US 11,543,768 B2
(45) Date of Patent: Jan. 3, 2023

(54) IMAGE FORMING APPARATUS

(71) Applicant: CANON KABUSHIKI KAISHA, Tokyo (JP)

(72) Inventors: Tetsuo Furukawa, Kanagawa (JP); Ryota Shibuya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,052

(22) Filed: Jun. 7, 2021

(65) Prior Publication Data

US 2021/0389719 A1 Dec. 16, 2021

(30) Foreign Application Priority Data

Jun. 12, 2020 (JP) ..... JP2020-102030

(51) Int. Cl.
*G03G 15/00* (2006.01)
*G03G 21/16* (2006.01)
*G03G 21/18* (2006.01)

(52) U.S. Cl.
CPC ..... *G03G 21/1652* (2013.01); *G03G 21/1875* (2013.01)

(58) Field of Classification Search
CPC ..... G03G 21/1652; G03G 21/1875; G03G 21/1885
USPC ..... 399/107, 110, 111
See application file for complete search history.

(56) References Cited

U.S. PATENT DOCUMENTS

| | | | | |
|---|---|---|---|---|
| 9,146,530 | B2 * | 9/2015 | Seto | G03G 21/1871 |
| 10,203,658 | B2 * | 2/2019 | Sakai | G03G 21/1885 |
| 10,732,545 | B2 * | 8/2020 | Takeuchi | G03G 15/0894 |

FOREIGN PATENT DOCUMENTS

| | | | |
|---|---|---|---|
| JP | 2013122579 | A | 6/2013 |
| JP | 2015011055 | A | 1/2015 |
| JP | 2015141398 | A | 8/2015 |

* cited by examiner

*Primary Examiner* — Hoan H Tran
(74) *Attorney, Agent, or Firm* — Canon U.S.A., Inc. I.P. Division

(57) ABSTRACT

An image forming apparatus includes a cartridge provided with a memory. The apparatus main body includes a frame, a movable electric contact unit including an electric contact portion contacting with the memory, and a holding member holding the electric contact portion and including an urging member urging the electric contact unit toward the memory in a mounted state of the cartridge, and a positioning portion positioning the electric contact unit in an unmounted state of the cartridge.

11 Claims, 8 Drawing Sheets

IMAGE FORMING APPARATUS

BACKGROUND

Field of the Disclosure

The present disclosure relates to an electrophotographic image forming apparatus including a cartridge mountable/demountable to/from the apparatus main body.

Description of the Related Art

There is a known configuration of a cartridge integrally including a photosensitive member and process members acting on the photosensitive member, the cartridge of which is mountable/demountable to/from the main body of an electrophotographic image forming apparatus.

Such a cartridge may include a memory unit storing information such as the serial number and a status regarding use of the cartridge. The memory unit included in a cartridge allows the image forming apparatus to maximize its performance through control of the image forming processes according to the status regarding use of the cartridge while the memory unit communicates with the main body of the apparatus.

In many cases, the communication of the memory unit with the main body of the apparatus is achieved by a contact method of the contact terminal of the memory unit coming into contact with the corresponding contact terminal of the main body of the apparatus with a connector or spring material.

Japanese Patent Application Laid-Open No. 2015-11055 discusses a configuration in which a contact terminal of an apparatus main body is moved to come into contact with the memory tag of the cartridge by interlocking with opening/closing operation of a cover that opens/closes an opening for mounting/demounting of a cartridge.

SUMMARY

According to an aspect of the present disclosure, an image forming apparatus includes a cartridge including a memory unit configured to store information and an apparatus main body to/from which the cartridge is mountable/demountable in a mounting direction. The apparatus main body includes a frame, a main body electric contact unit configured to move relative to the frame, the main body electric contact unit including a main body electric contact portion configured to come into electric contact with the memory unit of the cartridge, and a holding member holding the main body electric contact portion and including a positionable portion, an urging member configured to urge the main body electric contact unit to bring the main body electric contact portion into contact with the memory unit of the cartridge in a mounted state where the cartridge is mounted to the apparatus main body, one end and another end of the urging member being supported by the main body electric contact unit and the frame, respectively, and a positioning portion configured to engage with the positionable portion of the holding member to position the main body electric contact unit relative to the frame in an unmounted state where the cartridge is not mounted on the apparatus main body. The main body electric contact unit engages with the cartridge and is positioned at a first position by receiving urging force from the urging member in the mounted state, and the main body electric contact unit is positioned at a second position by the positionable portion of the holding member being positioned by the positioning portion of the frame in the unmounted state. The second position is different from the first position in a direction orthogonal to a direction of the urging force in the mounted state as viewed in a direction orthogonal to the mounting direction.

DESCRIPTION OF THE EMBODIMENTS

An image forming apparatus according to an exemplary embodiment of the present disclosure will be described.

<Image Forming Apparatus>

Figure 1:
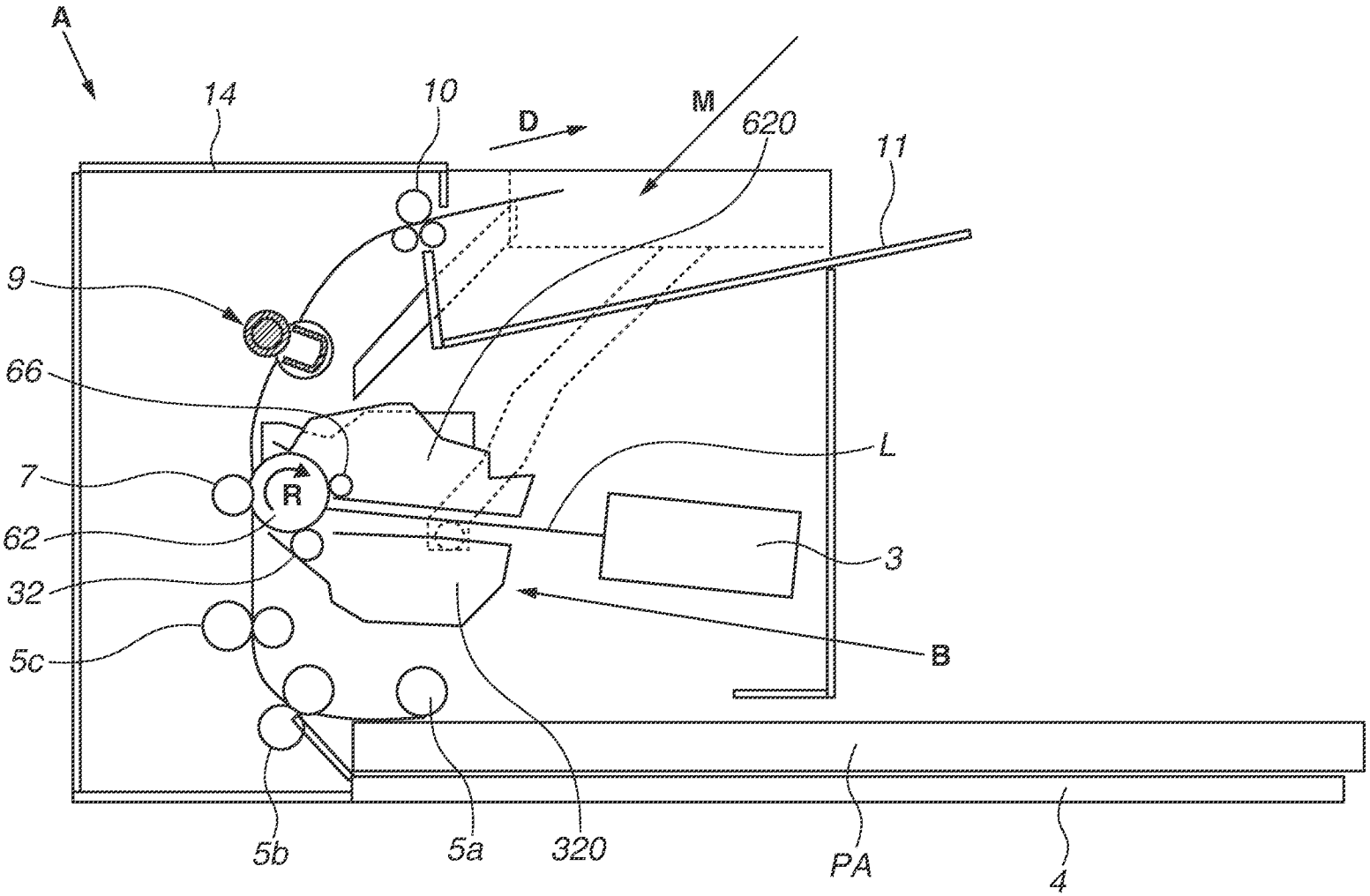
FIG. 1 is a cross-sectional view of a laser beam printer as an electrophotographic image forming apparatus according to an exemplary embodiment.

An entire configuration of the image forming apparatus will be described. FIG. 1 is a cross-sectional view of a laser beam printer as an electrophotographic image forming apparatus according to the present exemplary embodiment. The image forming apparatus includes an apparatus main body A and a process cartridge (hereinafter, referred to as a cartridge B) mountable/demountable to/from the apparatus main body A. The apparatus main body A is the portion of the image forming apparatus excluding the cartridge B. The cartridge B is mounted on the apparatus main body A in an arrow M direction in FIG. 1. In the following description, a state where the cartridge B is mounted on the apparatus main body A is referred to as a mounted state, and a state where the cartridge B is not mounted on the apparatus main body A is referred to as an unmounted state.

The cartridge B includes a drum unit 620 rotatably supporting a photosensitive drum 62, and a developing unit 320 rotatably supporting a developing roller 32. The developing unit 320 is supported by the drum unit 620 so that the developing unit 320 is swingable between a position where the developing roller 32 is closer to the photosensitive drum 62 and a position where the developing roller 32 is farther from the photosensitive drum 62.

The apparatus main body A includes an exposure device 3 (a laser scanner unit) forming a latent image on the photosensitive drum 62 as an image carrier of the cartridge B. Further, a sheet tray 4 storing a recording medium (hereinafter, referred to as sheet material PA) is provided below the cartridge B.

The apparatus main body A further includes a pickup roller 5*a*, a feeding roller pair 5*b*, a conveyance roller pair 5*c*, a transfer roller 7, a fusing device 9, a discharge roller pair 10, and a discharge tray 11, all of which are disposed in a conveyance direction D of the sheet material PA.

In the present exemplary embodiment, the mounting direction M of the cartridge B is orthogonal to the rotation axis of the photosensitive drum 62; however, the mounting direction M is not limited thereto.

<Image Forming Process>

An outline of an image forming process will be described. The photosensitive drum 62 is rotationally driven in an arrow R direction at a predetermined circumferential velocity (process speed) in response to a print start signal.

A charging roller (charging member) 66 with a bias voltage applied thereto is in contact with the outer peripheral surface of the photosensitive drum 62, and uniformly charges the outer peripheral surface of the photosensitive drum 62.

The exposure device 3 emits laser beams L based on image information. The laser beams L scan and expose the outer peripheral surface of the photosensitive drum 62, forming an electrostatic latent image corresponding to the image information on the outer peripheral surface of the photosensitive drum 62.

On the other hand, toner in the cartridge B is carried by the developing roller 32. Toner is supplied from the developing roller 32 to the photosensitive drum 62 according to the electrostatic latent image on the photosensitive drum 62, developing the electrostatic latent image. As a result, the electrostatic latent image on the photosensitive drum 62 is visualized in a toner image.

Further, as illustrated in FIG. 1, the sheet material PA is conveyed from the sheet tray 4 to the transfer position between the photosensitive drum 62 and the transfer roller 7 by the pickup roller 5*a*, the feeding roller pair 5*b*, and the conveyance roller pair 5*c*, in synchronization with the output timing of laser beams L. At the transfer position, the toner image is transferred from the photosensitive drum 62 to the sheet material PA.

The sheet material PA with the toner image transferred thereon is separated from the photosensitive drum 62 and is conveyed to the fusing device 9. The sheet material PA is subjected to pressurization and heat fusing processing at the nip portion in the fusing device 9, and the toner image is fixed on the sheet material PA. The sheet material PA through the fusing processing of the toner image is conveyed to the discharge roller pair 10 and is discharged onto the discharge tray 11.

<Memory Tag Substrate of Cartridge>

Figure 2A:
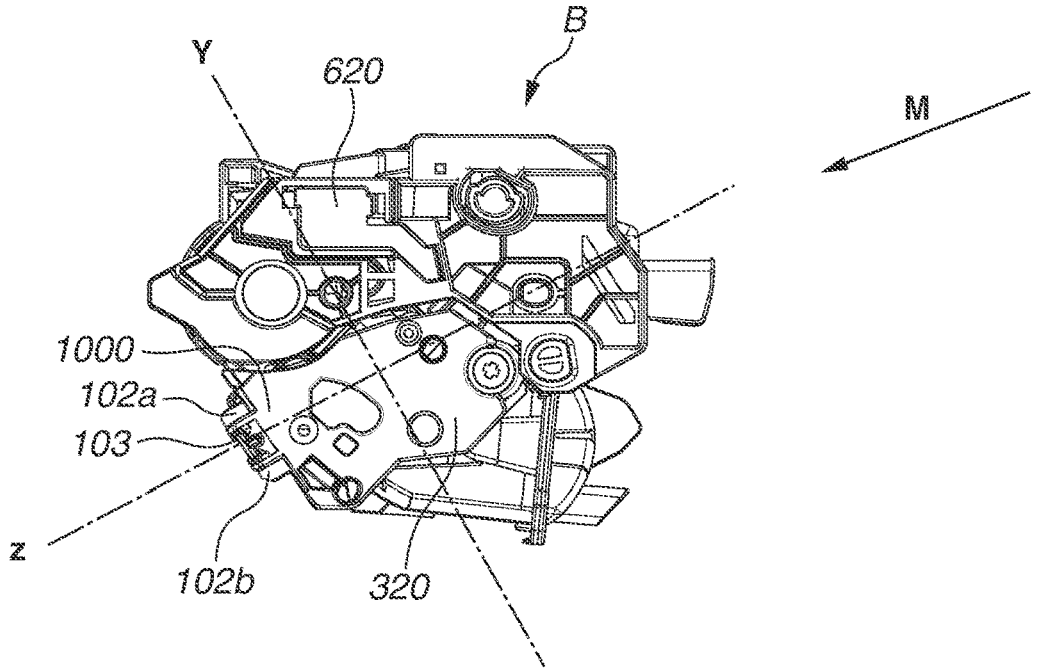
FIG. 2A is a side view of a cartridge according to the present exemplary embodiment.
Figure 2B:
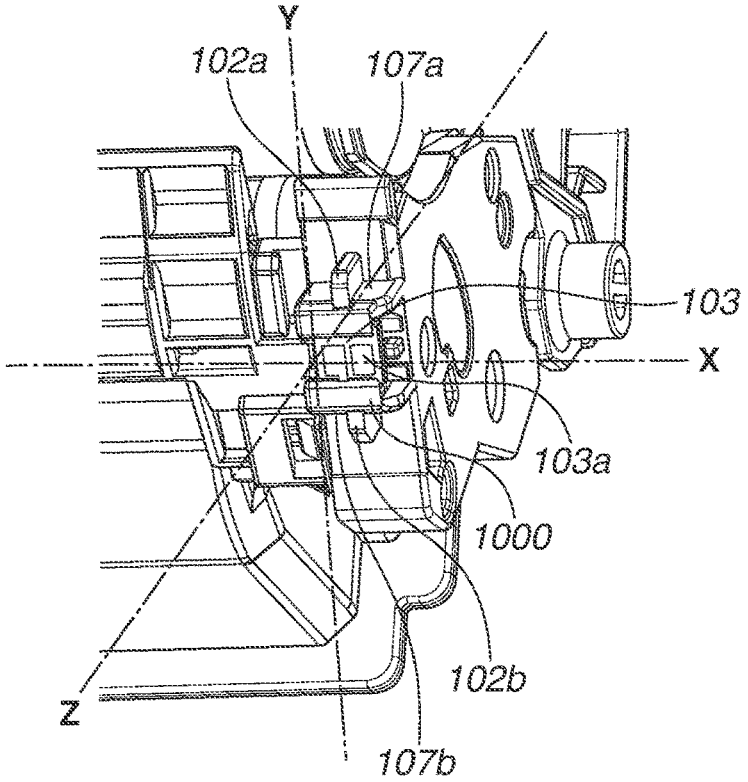
FIG. 2B is a perspective view of a longitudinal end part of the cartridge in view of a side provided with a memory tag board.

A memory tag board included in the cartridge B will be described. FIG. 2A is a side view of the cartridge B according to the present exemplary embodiment. FIG. 2B is a perspective view of a longitudinal end part of the cartridge B in view of a side provided with a memory tag board 103. In FIGS. 2A and 2B, a Z direction is perpendicular to the memory tag board 103, and a Y direction is perpendicular to an X direction and the Z direction. In FIG. 2B, the X direction is along the rotation axis of the photosensitive drum 62.

As illustrated in FIG. 2A, the cartridge B includes the memory tag board 103 (memory unit). The memory tag board 103 is held by a memory tag holding portion 1000 provided at one end surface of the developing unit 320 downstream in the mounting direction M (FIG. 1).

The memory tag board 103 includes a cartridge electric contact 103*a* and a memory as a storage unit. The memory stores information such as a serial number and a status regarding use of the cartridge B.

A memory tag holding portion 1000 includes a rib 102*a* and a rib 102*b* serving as positioning portions. The rib 102*a* and the rib 102*b* are arranged in the Y direction, and the memory tag board 103 is disposed in between. The rib 102*a* and the rib 102*b* extend in the Y direction and the Z direction.

<Connector Unit>

Figure 3A:
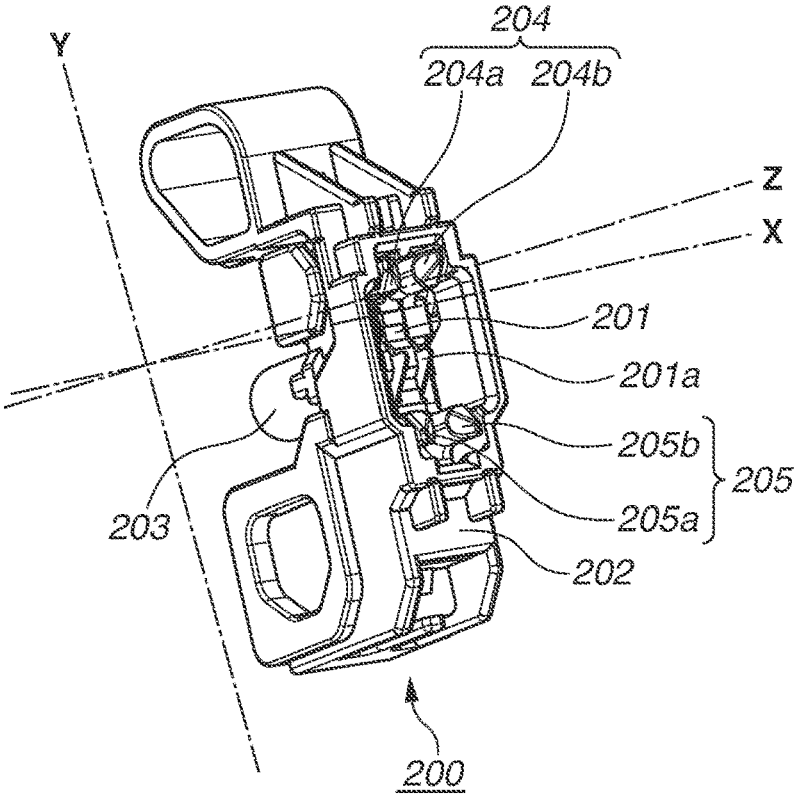
FIG. 3A is a perspective view of a connector unit and a coil spring.
Figure 3B:
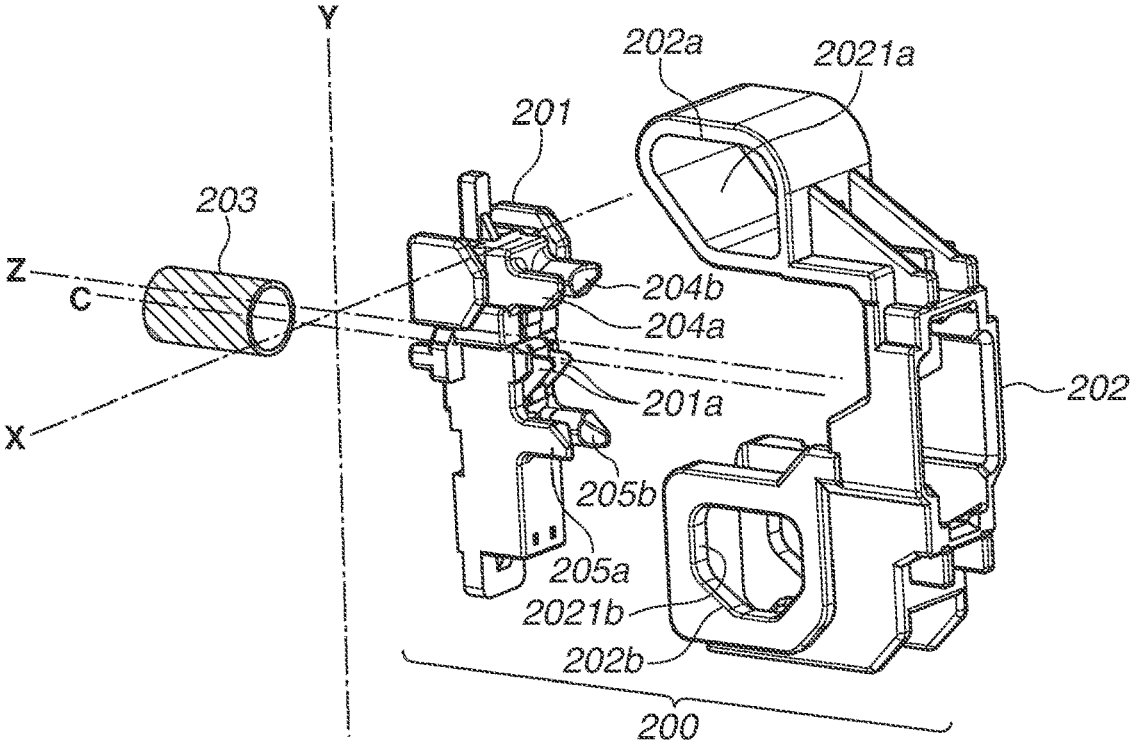
FIG. 3B is an exploded perspective view of the connector unit and the coil spring.
Figure 4:
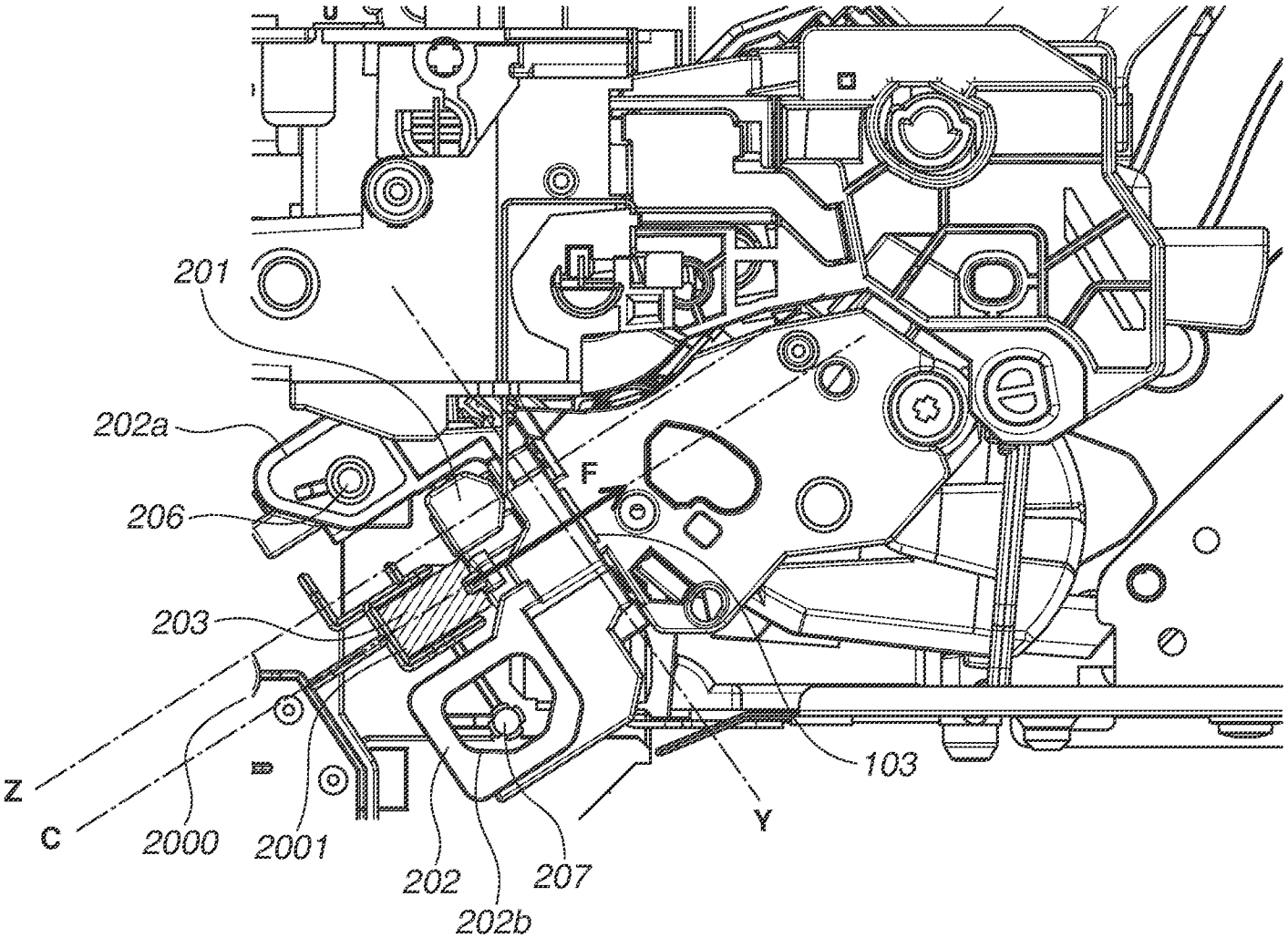
FIG. 4 is an enlarged view illustrating the position of the connector unit in a cartridge-mounted state.

A connector unit 200 of the apparatus main body A will be described. FIG. 3A is a perspective view of the connector unit 200 and a coil spring 203 according to the present exemplary embodiment. FIG. 3B is an exploded perspective view of the connector unit 200 and the coil spring 203 according to the present exemplary embodiment. FIG. 4 is an enlarged view illustrating a position of the connector unit 200 relative to the memory tag board 103 in a mounted state.

As illustrated in FIGS. 3A and 3B, the apparatus main body A includes the connector unit 200 (main body electric contact unit) and the coil spring 203 as an urging member (elastic member) urging the connector unit 200 toward the memory tag board 103 of the cartridge B. The coil spring 203 according to the present exemplary embodiment is a compression coil spring, and the coil spring 203 is disposed so that a center axis C is parallel with or substantially parallel with the Z direction (FIG. 4). In the present exemplary embodiment, the connector unit 200 is urged by the coil spring 203 only.

The connector unit 200 includes a connector 201 (main body electric contact portion) and a holding member 202 holding the connector 201. The connector 201 includes a main body electric contact 201*a* and protrusions 204 and 205 serving as portions to be positioned. The protrusion 204 includes protrusions 204*a* and 204*b* arranged with a space in the X direction. The protrusion 205 includes protrusions 205*a* and 205*b* arranged with a space in the X direction.

The holding member 202 holds the connector 201, and includes a first hole 202*a* and a second hole 202*b* serving as portions to be positioned (positionable portions) as illustrated in FIGS. 3A and 3B, and FIG. 4. Further, as illustrated in FIG. 3B, the first hole 202*a* and the second hole 202*b* include a first inner peripheral surface 2021*a* and a second inner peripheral surface 2021*b* extending in the X direction, respectively. Viewed in the X direction, the first hole 202*a* is opposite the second hole 202*b* with the coil spring 203. The holding member 202 is fixed integrally with the connector 201. To fix the holding member 202 to the connector 201, the holding member 202 may be bonded to the connector 201, or a tab portion to elastically deform provided to the holding member 202 may engage with the connector 201.

As illustrated in FIG. 4, the apparatus main body A includes a first shaft portion 206 (first boss) and a second shaft portion 207 (second boss) serving as positioning portions relative to the main body. The first shaft portion 206 and the second shaft portion 207 extend from a main body frame 2000 of the apparatus main body A in the direction (X direction) perpendicular to the Y direction and the Z direction, and are in the first hole 202*a* and the second hole 202*b* of the holding member 202, respectively.

As illustrated in FIG. 4, the first inner peripheral surface 2021*a* of the first hole 202*a* and the second inner peripheral surface 2021*b* of the second hole 202*b* are to come into contact with the first shaft portion 206 and the second shaft portion 207, respectively, restricting movement of the connector unit 200. As described above, the connector unit 200 is movable relative to the main body frame 2000 in a predetermined range in the Y direction and the Z direction.

As illustrated in FIG. 4, in a mounted state, the coil spring 203 urges the connector 201 in a direction in which the connector unit 200 approaches the memory tag board 103 of the cartridge B. One end and the other end of the coil spring 203 are supported by the connector 201 and a spring support portion 2001 of the main body frame 2000, respectively. In the mounted state illustrated in FIG. 4, the connector 201 receives the urging force from the coil spring 203 in a direction F.

<Position of Connector Unit in Mounted State>

Figure 5A:
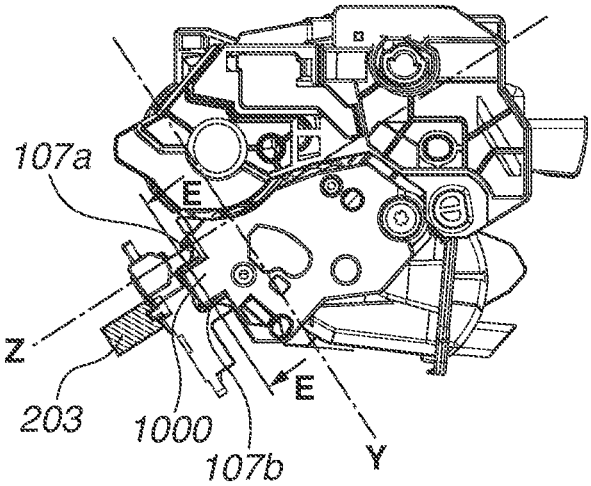
FIG. 5A is a diagram of a memory tag holding portion, a connector, and the coil spring in the mounted state as viewed in an X direction.
Figure 5B:
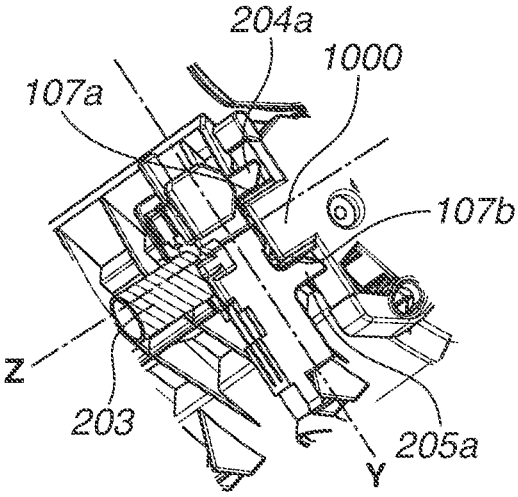
FIG. 5B is an enlarged view illustrating a vicinity of the connector.
Figure 5C:
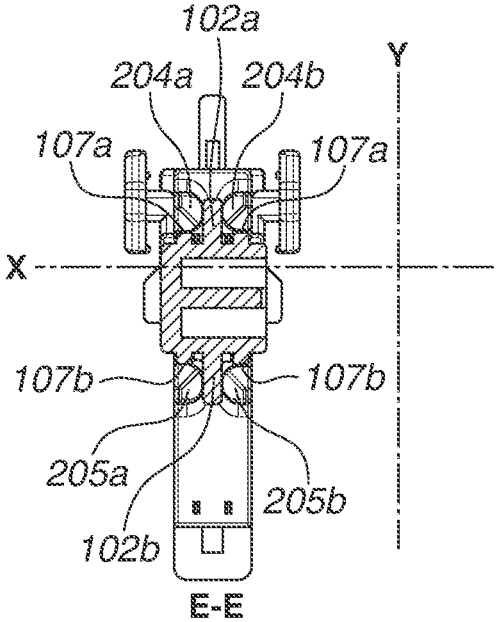
FIG. 5C is a cross-sectional view taken along line E-E in FIG. 5A.

The position and positioning of the connector unit 200 in the mounted state will be described with reference to FIG. 4 and FIGS. 5A to 5C. FIG. 5A is a diagram of the memory tag holding portion 1000, the connector 201, and the coil spring 203 in the mounted state as viewed in the X direction. FIG. 5B is an enlarged view illustrating a vicinity of the connector 201. FIG. 5C is a cross-sectional view taken along line E-E in FIG. 5A. In FIGS. 5A to 5C, the illustration of the holding member 202 is omitted for easy vision of the positioning structure.

In the mounted state, the connector unit 200 is positioned to the cartridge B in engagement with the memory tag holding portion 1000. The position of the memory tag board 103 here is referred to as a first position.

A positioning configuration of the connector unit 200 relative to the memory tag holding portion 1000 will be described. As illustrated in FIG. 5C, the rib 102*a* and the rib 102*b* of the memory tag holding portion 1000 are fitted into the space between the protrusions 204*a* and 204*b* and the space between the protrusions 205*a* and 205*b* of the connector 201, respectively. This configuration positions the connector unit 200 in the X direction. Further, the portion (positioning portion) between a surface 107*a* and a surface 107*b* of the memory tag holding portion 1000 is fitted into the space between the protrusion 204*a* and the protrusion 205*a* and the space between the protrusion 204*b* and the protrusion 205*b* of the connector 201, positioning the connector unit 200 in the Y direction.

In the mounted state, the coil spring 203 urges the connector 201 in the direction in which the connector unit 200 (connector 201) approaches the memory tag board 103 of the cartridge B. As a result, the connector 201 comes into contact with the end surface of the memory tag holding portion 1000, positioning the connector unit 200 in the Z direction.

One end and the other end of the coil spring 203 are supported by the connector 201 and the spring support portion 2001 of the main body frame 2000, respectively. In addition, the center axis C of the coil spring 203 in the mounted state is parallel with or substantially parallel with the Z direction.

As described above, the connector unit 200 positioned relative to the memory tag holding portion 1000 allows the main body electric contact 201*a* of the connector 201 and the cartridge electric contact 103*a* of the memory tag board 103 to be in contact with each other to become electrically communicable.

Further, in the mounted state, the first inner peripheral surface 2021*a* of the first hole 202*a* and the second inner peripheral surface 2021*b* of the second hole 202*b* of the holding member 202 are out of contact with the first shaft portion 206 (first boss) and the second shaft portion 207 (second boss), respectively. This improves the positional accuracy of the connector unit 200 relative to the memory tag board 103 of the cartridge B.

<Position of Connector Unit in Unmounted State>

Figure 6:
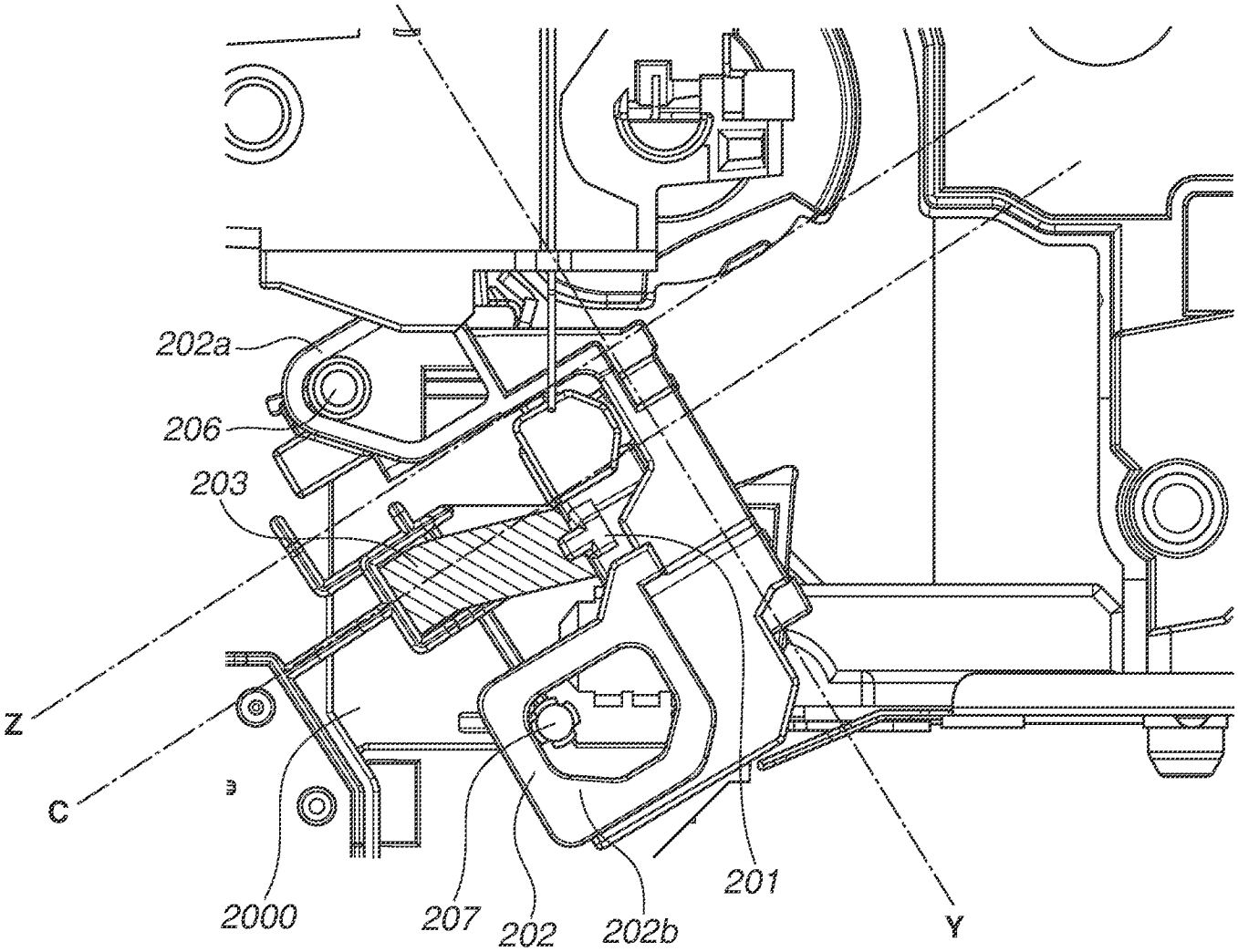
FIG. 6 is an enlarged view illustrating the position of the connector unit in a cartridge-unmounted state.

The position of the connector unit 200 in the unmounted state in the present exemplary embodiment will be described. FIG. 6 is an enlarged view illustrating the position of the connector unit 200 in an unmounted state.

In the unmounted state, the connector unit 200 is at a position (second position) below the first position in a direction intersecting (orthogonal to) the center axis C as viewed in the direction (X direction) orthogonal to the mounting direction.

The second position of the connector unit 200 is a position where the memory tag holding portion 1000 of the cartridge B allows easy engagement with the connector unit 200 of the apparatus main body A in terms of the mounting path of the cartridge B onto the apparatus main body A. This will be described below.

In the unmounted state, the connector unit 200 is positioned by the main body frame 2000. The first inner peripheral surface 2021*a* of the first hole 202*a* and the second inner peripheral surface 2021*b* of the second hole 202*b* of the holding member 202 come into contact with the first shaft portion 206 and the second shaft portion 207, respectively, by the urging force of the coil spring 203, positioning the connector unit 200 relative to the main body frame 2000 in the Y direction and the Z direction. More specifically, the cylindrical surface of the first shaft portion 206 comes into contact with the first inner peripheral surface 2021*a*, positioning the center position of the holding member 202. The second shaft portion 207 comes into contact with the second inner peripheral surface 2021*b*, restricting the rotation of the holding member 202 around the first shaft portion 206. Thus, the connector unit 200 with the holding member 202 positioned by the main body frame 2000 is positioned at the second position shifted downward from the first position in the direction orthogonal to (intersecting) the center axis C (Z direction).

The direction of the center axis C is the same as the direction F of the urging force applied from the coil spring 203 to the connector 201 in the mounted state as illustrated in FIG. 4. In other words, the second position of the connector unit 200 in the present exemplary embodiment is different from the first position in the direction intersecting the direction F of the urging force applied from the coil spring 203 to the connector 201 in the mounted state.

There is a conventional configuration that includes an urging member such as a tension spring, in addition to the coil spring 203, to urge the connector 201 in a direction intersecting the direction F of the urging force, to cause the connector unit 200 to stand by at a position different from a position in the mounted state in the direction intersecting (orthogonal to) the direction F of the urging force applied from the coil spring 203 to the connector 201. With the configuration, there is an issue that the force in an additional direction for bringing the main body electric contact of the connector unit into contact with the cartridge electrical contact in the mounted state continuously acts on the connector unit. In contrast, in the present exemplary embodiment, the connector unit 200 in the unmounted state is positioned by the simple configuration with the coil spring 203, the holding member 202, the first shaft portion 206, and the second shaft portion 207. Thus, this has an effect of keeping the main body electric contact in proper contact with the cartridge electrical contact, without the force acting on the connector unit in the additional direction in the mounted state.

<Cartridge Mounting Path and Position of Connector Unit>

Figures 7A, 7B, 7C:
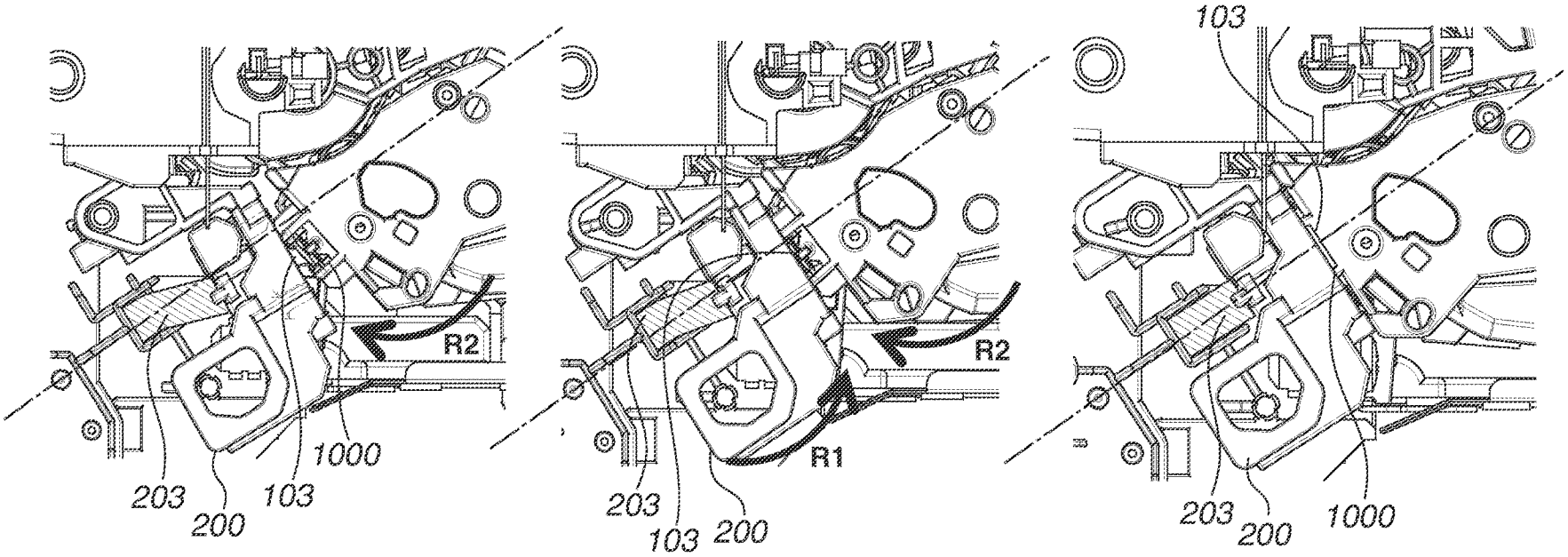
FIG. 7A is an enlarged view illustrating the positions of the memory tag board and the connector unit immediately before the memory tag holding portion of the cartridge engages with the connector unit.
FIG. 7B is an enlarged view illustrating the positions of the memory tag board and the connector unit as the memory tag holding portion of the cartridge starts to engage with the connector unit.
FIG. 7C is an enlarged view illustrating the positions of the memory tag board and the connector unit as the memory tag holding portion of the cartridge engages with the connector unit at a first position.

The mounting path of the cartridge B onto the apparatus main body A and the position of the connector unit 200 will be described. FIG. 7A is an enlarged view illustrating the positions of the memory tag board 103 and the connector unit 200 immediately before the memory tag holding portion 1000 of the cartridge B engages with the connector unit 200. FIG. 7B is an enlarged view illustrating the positions of the memory tag board 103 and the connector unit 200 as the memory tag holding portion 1000 of the cartridge B starts to engage with the connector unit 200. FIG. 7C is a diagram illustrating the positions of the memory tag board 103 and the connector unit 200 as the mounting of the cartridge B on the apparatus main body A is completed.

In mounting of the cartridge B on the apparatus main body A, after the cartridge B reaches the position illustrated in FIG. 7A, the cartridge B moves while being guided by guide portions on the apparatus main body A to change the orientation of the cartridge B to an arrow R2 direction. At this time, the connector unit 200 stands by at the second position. Next, as illustrated in FIG. 7B, the connector unit 200 starts to engage with the memory tag holding portion 1000, and moves while changing the orientation of the connector unit 200 to an arrow R1 direction with movement of the cartridge B in the arrow R2 direction, reaching the first position illustrated in FIG. 7C.

As described above, the connector unit 200 in the middle of the movement of itself engages with the memory tag holding portion 1000 moving as the orientation of the memory tag holding portion 1000 is changing upward with movement of the cartridge B. The connector unit 200 standing by at the second position below the first position in the direction orthogonal to the center axis C therefore allows easy engagement with the memory tag holding portion 1000.

In the present exemplary embodiment, the second position of the connector unit 200 is below the first position in the direction intersecting the center axis C. However, the second positon may be different from the first position in the direction intersecting the center axis C.

<Swing of Developing Unit>

Figure 8:
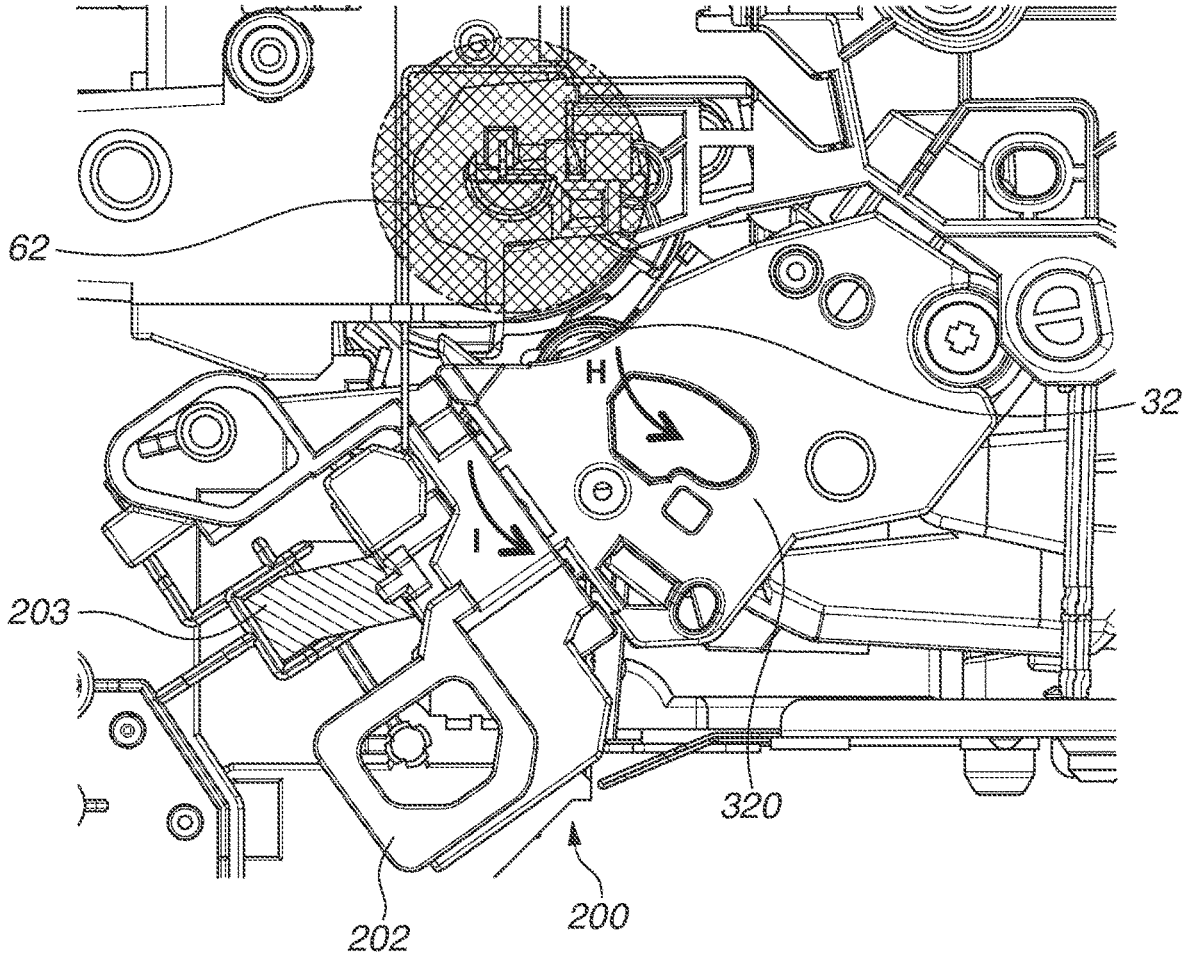
FIG. 8 is an enlarged view illustrating the position of the connector unit as the developing unit swings.

FIG. 8 is an enlarged view illustrating the position of the connector unit 200 as the developing unit 320 swings relative to the drum unit 620 in the cartridge B in the mounted state.

A case will be described where the memory tag board 103 of the cartridge B is moving in a direction (arrow H) away from the connector unit 200 as the developing roller 32 is being separated from the photosensitive drum 62. The connector unit 200 is urged by the coil spring 203 toward the memory tag board 103, keeping the engagement with the memory tag board 103 even as the developing unit 320 swings. The connector unit 200 moves in an arrow I direction following the memory tag board 103, keeping the main body electric contact 201*a* in contact with the cartridge electric contact 103*a*.

The coil spring according to the present exemplary embodiment is a compression coil spring; however, another urging member such as a tension coil spring, a torsion coil spring, and a rubber may be used. Further, with a different path of mounting a cartridge along a guide member shape onto the apparatus main body from the case in the present exemplary embodiment, the effect according to the exemplary embodiment of the present disclosure is achieved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-102030, filed Jun. 12, 2020, which is hereby incorporated by reference herein in its entirety.

What is claimed is:

1. An image forming apparatus, comprising:

a cartridge including a memory unit configured to store information; and an apparatus main body to/from which the cartridge is mountable/demountable in a mounting direction, the apparatus main body including:

a frame;

a main body electric contact unit configured to move relative to the frame, the main body electric contact unit including a main body electric contact portion configured to come into electric contact with the memory unit of the cartridge, and a holding member holding the main body electric contact portion and including a positionable portion;

an urging member configured to urge the main body electric contact unit to bring the main body electric contact portion into contact with the memory unit of the cartridge in a mounted state where the cartridge is mounted to the apparatus main body, one end and another end of the urging member being supported by the main body electric contact unit and the frame, respectively; and a positioning portion configured to engage with the positionable portion of the holding member to position the main body electric contact unit relative to the frame in an unmounted state where the cartridge is not mounted on the apparatus main body, wherein the main body electric contact unit engages with the cartridge and is positioned at a first position by receiving urging force from the urging member in the mounted state, and the main body electric contact unit is positioned at a second position by the positionable portion of the holding member being positioned by the positioning portion of the frame in the unmounted state, and wherein the second position is different from the first position in a first direction orthogonal to a direction of the urging force in the mounted state as viewed in a second direction orthogonal to the mounting direction and the first direction.

2. The image forming apparatus according to claim 1, wherein the positioning portion of the apparatus main body includes a first boss and a second boss extending in the second direction orthogonal to the mounting direction, wherein the positionable portion of the holding member includes a first hole including a first inner peripheral surface extending in the second direction orthogonal to the mounting direction, and a second hole including a second inner peripheral surface extending in the second direction orthogonal to the mounting direction, wherein the main body electric contact unit is positioned at the second position by the first boss and the second boss coming into contact with the first inner peripheral surface and the second inner peripheral surface in the unmounted state, respectively, and wherein the main body electric contact unit is positioned at the first position by engaging with the cartridge in the mounted state with the first boss and the second boss out of contact with the first inner peripheral surface and the second inner peripheral surface, respectively.

3. The image forming apparatus according to claim 2, wherein the first hole of the holding member is arranged at a position opposite to the second hole with the urging member as viewed in the first direction orthogonal to the mounting direction.

4. The image forming apparatus according to claim 1, wherein the urging member is a compression coil spring, and wherein the direction of the urging force in the mounted state is parallel to a direction of a center axis of the compression coil spring.

5. The image forming apparatus according to claim 1, wherein the urging member is the only urging member for urging the holding member.

6. The image forming apparatus according to claim 1, wherein the cartridge includes a photosensitive drum configured to rotate around a rotation axis, and wherein the mounting direction is a direction crossing the rotation axis.

7. The image forming apparatus according to claim 1, wherein the second position is below the first position in the direction of gravity.

8. An image forming apparatus, comprising:

a cartridge including a memory unit configured to store information; and an apparatus main body to/from which the cartridge is mountable/demountable in a mounting direction, the apparatus main body including:

a frame;

a main body electric contact unit configured to move relative to the frame, the main body electric contact unit including a main body electric contact portion configured to come into electric contact with the memory unit of the cartridge, and a holding member holding the main body electric contact portion and including a positionable portion;

a compression coil spring configured to urge the main body electric contact unit to bring the main body electric contact portion into contact with the memory unit of the cartridge in a mounted state where the cartridge is mounted to the apparatus main body, one end and another end of the compression coil spring being supported by the main body electric contact unit and the frame, respectively, in a direction of a center axis of the compression coil spring; and a positioning portion configured to engage with the positionable portion of the holding member to position the main body electric contact unit relative to the frame in an unmounted state where the cartridge is not mounted on the apparatus main body, wherein the main body electric contact unit engages with the cartridge and is positioned at a first position by receiving urging force from the compression coil spring in the mounted state, and the main body electric contact unit is positioned at a second position by the positionable portion of the holding member being positioned by the positioning portion of the frame in the unmounted state, and wherein the second position is different from the first position in a first direction orthogonal to the direction of the center axis of the compression coil spring in the mounted state as viewed in a second direction orthogonal to the mounting direction and the first direction.

9. The image forming apparatus according to claim 8, wherein the compression coil spring is an only spring urging the holding member.

10. The image forming apparatus according to claim 8, wherein the cartridge includes a photosensitive drum configured to rotate around a rotation axis, and wherein the mounting direction is a direction orthogonal to the rotation axis.

11. The image forming apparatus according to claim 8, wherein the second position is below the first position in a gravitational direction.

* * * * *